United States Patent [19]

Donner

[11] 4,005,544

[45] Feb. 1, 1977

[54] PARACHUTE TOY

[76] Inventor: Donald L. Donner, P.O. Box 97, Rte. 2, Durham, Calif. 95938

[22] Filed: July 28, 1975

[21] Appl. No.: 599,633

[52] U.S. Cl. ..... 46/86 R

[51] Int. Cl.[2] ..... A63H 33/20

[58] Field of Search ..... 46/86 R, 86 A, 86 B, 46/86 C

[56] References Cited

UNITED STATES PATENTS

| | | | |
|---|---|---|---|
| 2,199,163 | 4/1940 | Quady | 46/86 R |
| 3,055,141 | 9/1962 | Starkl | 46/86 A |

*Primary Examiner*—Hugh R. Chamblee
*Assistant Examiner*—Robert F. Cutting
*Attorney, Agent, or Firm*—Seed, Berry, Vernon & Baynham

[57] ABSTRACT

A parachute toy having a parachute connected to a hollow capsule adapted to receive the parachute in its undeployed condition. An air intake at the front of the capsule contains an air valve for selectively allowing airflow into the interior of the capsule to deploy the parachute. The parachute is initially in its undeployed condition and the toy is whirled about in a circular path by a string. The string is subsequently released, allowing centrifugal force to fling the toy into the air. At the apex of flight, the air valve automatically opens, allowing air to flow into the toy body and deploy the parachute. The parachute supports the capsule as the capsule falls slowly back to the ground. The toy further includes means for quickly and easily returning the parachute to its undeployed position inside the capsule.

11 Claims, 6 Drawing Figures

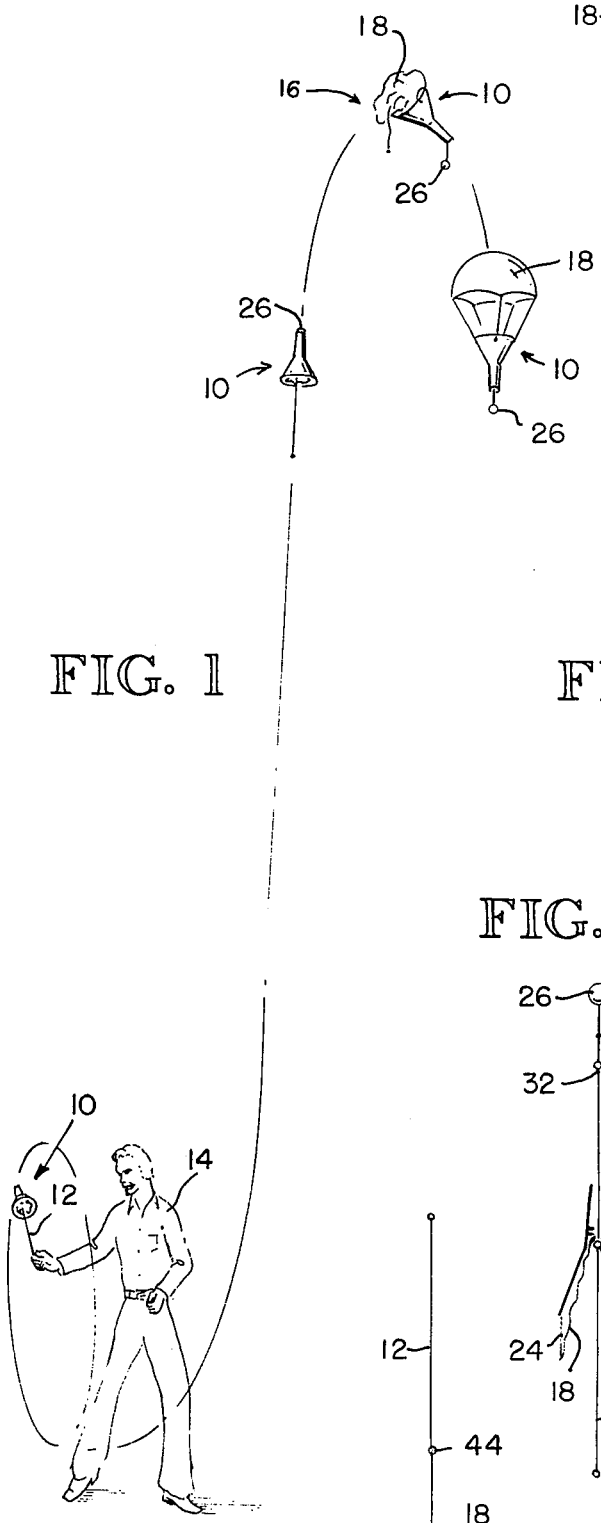
FIG. 1
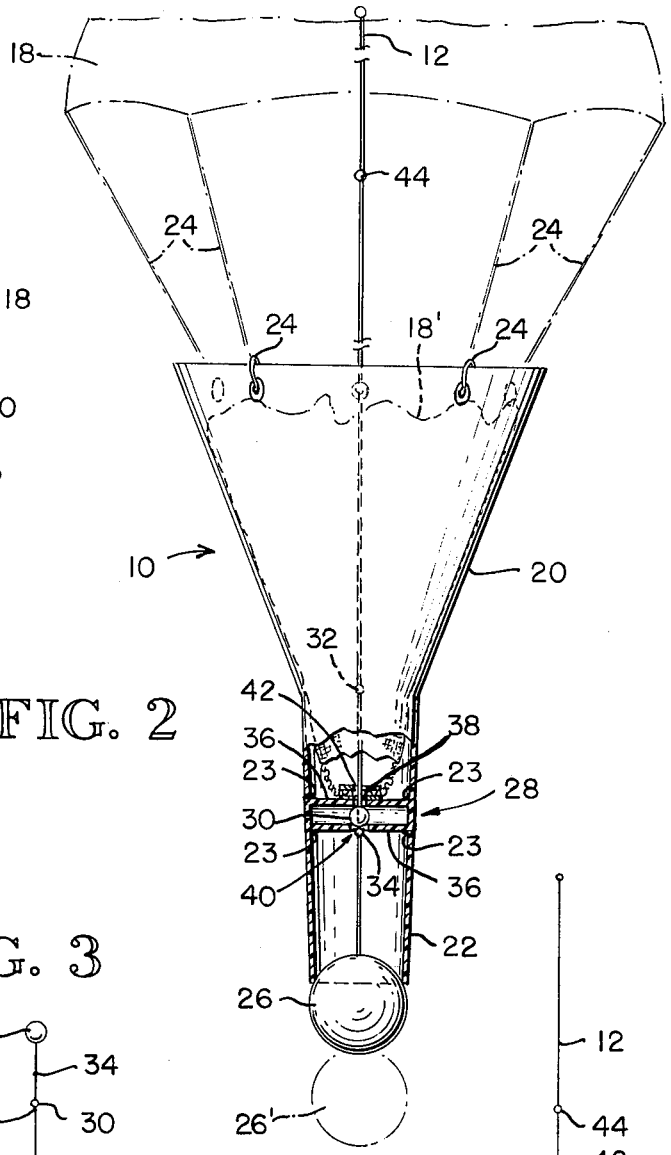
FIG. 2
FIG. 3
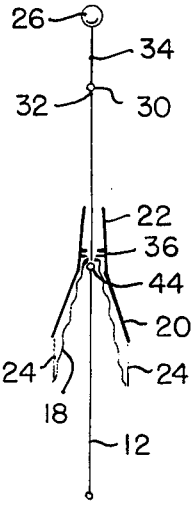
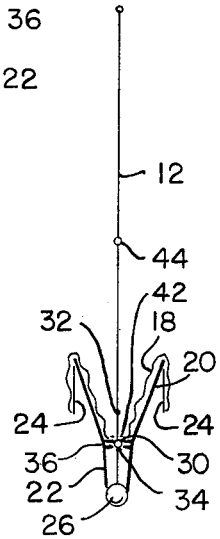
FIG. 4
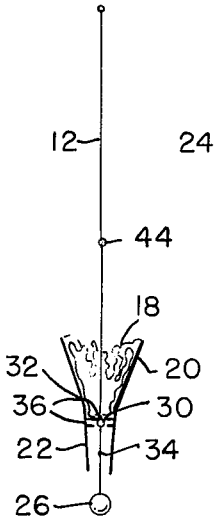
FIG. 5
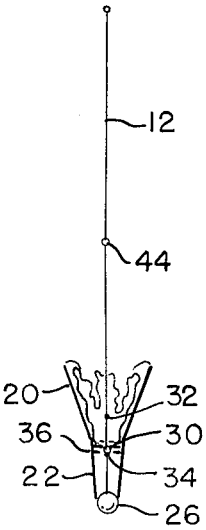
FIG. 6

PARACHUTE TOY

BACKGROUND OF THE INVENTION

1. Field of the Invention

This invention relates to toys and, more particularly, to a toy which, after being flung into the air, falls to the ground supported by a parachute which has been deployed in mid-flight.

2. Description of the Prior Art

Many toys have been developed in response to an increasing interest in aeronautics and aerospace. These toys have generally attempted to simulate actual airborne devices as realistically as possible. However, devices achieving an accurate simulation have often been relatively expensive or difficult to use. Other devices, while somewhat inexpensive and easy to use, have not performed satisfactorily. Other toys, for example, the devices illustrated in U.S. Pat. Nos. 3,177,612 and 2,312,629, require a separate launcher, and one of those devices separates into two portions in mid-flight, only one of which is subsequently supported by a parachute.

SUMMARY OF THE INVENTION

It is an object of the invention to provide a toy which accurately simulates the landing of a space capsule after reentry from outer space.

It is another object of the invention to provide a toy which deploys a parachute at the apex of flight, thereby providing a flight of maximum duration.

It is still another object of the invention to provide a toy which may be launched without using a separate launching device.

These and other objects of the invention are accomplished by a parachute toy having a hollow capsule connected by lines to a parachute. The parachute is initially placed in an undeployed position in the interior of the capsule, and the capsule is flung into the air. The forward end of the capsule contains an air inlet for allowing airflow into the capsule to deploy the parachute. The airflow through the air inlet is controlled by a valve which opens at the approximate apex of flight to deploy the parachute. The valve includes a seating element fastened to the end of a line which extends rearwardly through the center of the capsule. The capsule is flung into the air by grasping the end of the string, whirling the toy in a circular path and releasing the string while the toy is in upward motion. While the toy is moving in a circular path, the string holds the seating element seated against the end of the air inlet to prevent airflow through the air inlet, thereby preventing the parachute from being deployed. During upward movement of the capsule, the seating element is held against the air inlet seat by gravity. At the apex of flight, the capsule tilts to a horizontal position, causing the seating element to fall away from the air inlet, opening the valve. When the toy returns to the ground, the parachute is placed in its undeployed position inside the capsule by pulling the seating element forward, thereby releasing a latching mechanism holding the line in place. As the line moves forwardly, a restraining bead secured to the line contacts the parachute and carries the parachute forward into the interior of the capsule. After the parachute has been placed inside the capsule, the latching mechanism is placed in its original condition by pulling the line rearward, and the toy is once again ready for flight.

BRIEF DESCRIPTION OF THE DRAWINGS

FIG. 1 is an isometric view showing use of the toy at various positions during the flight.

FIG. 2 is a partial cross-sectional view showing the toy with the parachute in its deployed condition.

FIGS 3 through 6 are schematic views illustrating the toy in various conditions before, during and after flight.

DETAILED DESCRIPTION OF THE INVENTION

The parachute toy is shown in use in FIG. 1. The parachute toy 10 is connected to a line 12 which the user 14 grasps to whirl the toy 10 in a circular arc. At the upswing in the arc, the toy 10 is released, allowing centrifugal force to carry the toy upward. At the apex of flight 16, a parachute 18 is deployed to support the toy 10 as it falls slowly back to the ground.

The construction details of the parachute toy are illustrated in FIG. 2. The toy 10 includes a conical capsule or body 20 having an open back. The forward end of the capsule 20 terminates in a cylindrical air inlet 22, preferably an integral part of the capsule 20. The capsule 20 and inlet 22 may be formed from a variety of materials, but a resilient plastic is preferable. The parachute 18 is connected to the capsule by lines 24 spaced apart along the periphery of the parachute 18 and capsule 20 along the back end thereof. The line 12 used to whirl the toy 10 in a circular path extends longitudinally through the center of the capsule 20 and air inlet 22, and is connected to a seating element 26. The seating element 26 is shown here as a spherical ball, but any structure capable of covering the front of the air inlet 22 may be used. The line 12 extends through a releasable latching mechanism 28, illustrated in further detail in FIG. 3. A latching element 30, such as a bead, is slidably secured to the line 12 between a pair of stops 32, 34. The knots 32, 34 are of sufficient size to prevent the bead 30 from sliding along the line 12 past either stop 32, 34. Although the stops 32, 34 are shown here as knots, any structure fastened to the line to prevent relative motion between the bead 30 and the line 12 may be used. The latching mechanism 28 further includes a cross-tube 36 having a pair of opposed apertures 38, 40. The cross-tube 36 extends through bores on opposite sides of the air inlet 22 where it is secured by adhesive 23. However, other fastening means are also satisfactory. The rear aperture 38 is of sufficient size to receive the line 12 and knots 32, 34, but is significantly smaller than the bead 30. The forward aperture 40 is slightly smaller than the bead 30 and, since the cross-tube 36 is of resilient material, the bead 30 may be forced through the aperture 40. The latching mechanism 28, as illustrated in FIG. 2, is in its latched position wherein the bead 30 is held at the center of the cross-tube 36. When the mechanism 28 is latched, the seating element 26 may occupy either of two positions. When the knot 34 abuts the bead 30, the seating element 26 covers the air inlet 22, as shown in FIG. 2. This condition occurs under two circumstances. First, when the parachute toy 10 is being whirled in a circular path, as shown in FIG. 1, the outwardly directed centrifugal force of the capsule 20 and air inlet 22 against the radially fixed seating element 26 mantains the seating element 26 in contact with the end of the air inlet 22. Second, when the capsule 20 is moving upwardly during flight, the inlet 22 is upwardly disposed as shown in FIG. 1. Under these circumstances, the seating member 26 is held against the end of the air inlet 22 by gravity. As the apex of flight is reached, the capsule 20 tilts from an upward to a downward orientation and the seating element 26 falls away from the end of the air inlet 22, as shown in FIG. 1 and in phantom in FIG. 2. In this position, the line 12 slides through the bead 30 until the knot 32 abuts the bead 30. The seating member 36 is thus held a predetermined distance from the end of the air inlet 22. In its undeployed position, the parachute is placed inside the capsule 20 as shown in phantom as 18' in FIG. 2. As the parachute toy 10 begins its descent, air flows into the capsule 20 through the air inlet 22 and forces the parachute 18' from the capsule 20 as shown at 18 in FIG. 2.

The parachute toy 10 further includes means for quickly and easily packing the parachute 18 in its undeployed position inside the capsule 20. With reference to FIG. 3, after the flight, the user grasps the seating element 26 and pulls away from the air inlet 22 until the knot 32 contacts the bead 30 and carries the bead 30 through the aperture 40 so that the mechanism 28 is in its unlatched position. The parachute 18 contains a central aperture 42 which may be reinforced with a washer through which the line 12 extends. A button or other stopping device 44 is fixedly secured to the line 12 to the rear of the aperture 42. As the seating element 26 is further pulled away from the end of the air inlet 22, the button 44 contacts the parachute 18 and pulls the parachute 18 inside the capsule 20. The toy is then inverted, as shown in FIG. 4, and the line 12 is pulled rearwardly through the capsule 20 so that the knot 34 carries the bead 30 through the aperture 40 in the cross-tube 36 to place the mechanism 28 in its latched position. Finally, the edges of the parachute 18 extending beyond the rear edges of the capsule 20 are tucked inside, as shown in FIG. 5, placing the parachute toy in condition for another flight. Since the capsule 20 is a rearwardly diverging cone, the parachute can be easily tucked into its confines so that loose edges of the parachute will not be exposed to the air-stream which could cause premature deployment. When the end of the string 12 is grapsed by the user, the seating element 26 covers the air inlet 22 as shown in FIG. 6 so that the parachute 18 is not deployed during flight.

In the embodiments of the invention in which a particular property or privilege is claimed are defined as follows:

1. A parachute toy launched by whirling said toy in a circular path at the end of a string, said toy comprising:

a hollow capsule having an open back end and a front end containing an air inlet for admitting air into said capsule;

a parachute stored in the interior of said capsule while said parachute is undeployed;

support means connecting said parachute to said capsule for suspending said capsule from said parachute while said parachute is deployed;

a line extending rearwardly from said capsule to restrain radial movement of said capsule while said capsule is whirled about in a circular path;

air valve means for selectively allowing airflow through said air inlet into the interior of said capsule to deploy said parachute, said air valve means opening at the approximate apex of flight responsive to shifting of the angle of flight from up to down; and valve closing means operatively associated with said line for maintaining said valve means closed during launch responsive to the centrifugal force exerted on said line by said toy.

2. The parachute of claim 1 wherein said valve means comprise:

an annular valve seat formed at the forward end of said air inlet;

a cover member adapted to mate with said valve seat when said valve seat is positioned beneath, and supporting, said cover member; and restraining means connecting said cover members to said capsule.

3. The parachute toy of claim 2 wherein the forward end of said line is connected to said cover member and said line extends rearwardly through a central aperture in said parachute, said line having secured thereto to the rear of said aperture a restraining button larger than said aperture, said toy further including a releasable latching means for fixing the position of said line such that in the latched condition the movement of said cover member is limited to a predetermined range and in the unlatched condition said cover member may be moved forwardly, causing said restraining button to carry said parachute into the interior of said capsule.

4. The parachute toy of claim 3 wherein said valve closing means is formed by slidably securing said line to said releasable latching means so that the radial force imparted to said capsule during circular motion seats said radially stationary cover member against said valve seat to prevent airflow through said air inlet.

5. The parachute toy of claim 3 wherein said releasable latch means comprise:

a hollow, resilient cross-member having a first aperture on one surface and a second aperture on a surface directly opposite said fist aperture, said second aperture being larger than said first aperture, said line passing through both of said apertures;

a latching element slidably engaging said line between said second opening and said cover member, said latching member being slightly larger than said second aperture and significantly larger than said first aperture;

a first stop on said line between said latching member and said cover member for preventing relative movement between said line and latching element so that rearward movement of said latching element responsive to rearward movement of said line latches said latching element between said first and second apertures; and a second stop on said line rearward of said latching element for preventing forward movement of said cover member when said latching element is between said apertures, said latching element being removable from said cross-member responsive to forward movement of said line, thereby packing said parachute inside said capsule.

6. In a parachute toy adapted to be whirled about on a line in a circular path and subsequently released, said toy having a hollow body with an open back, a parachute stored in said body when said parachute is undeployed, air inlet means for selectively allowing airflow through the forward wall of said body to deploy said parachute and supporting means connecting said body to said parachute so that said parachute supports said body in its deployed condition, said air inlet means including valve means at operatively associated with said line for opening said air inlet means during the shifting of said body from an upward to a downward orientation at the approximate apex of flight and for maintaining said valve means closed while said toy is being whirled about in a circular path responsive to the centrifugal force exerted on said line by said toy.

7. The parachute toy of claim 6 wherein said valve means comprise:

an annular seat at the forward end of said air inlet means;

a seating element adapted to cover said air inlet;

securing means for maintaining said seating element in contact with said seat when said toy is being whirled about; and restraining means for maintaining said seating element adjacent said seat so that said seating element remains with said toy body after being unseated from said annular seat when said toy body tilts downwardly at the approximately apex of flight.

8. The parachute toy of claim 7 wherein said securing means and said restraining means are formed by securing said line to said seating element and extending it through said air inlet means and beyond said open back, said line further having means for limiting the forward movement of said line through said air inlet means to limit unseating of said seating element.

9. In a parachute toy having a hollow body with an open back, a parachute stored in said body when said parachute is undeployed and means for placing said parachute in its undeployed position, said means comprising:

a line extending from the forward end of said body rearwardly through a central aperture in said parachute; and a restraining button secured to said line rearwardly of said aperture, said button being larger than said aperture whereby said parachute may be placed in its undeployed position by pulling the forward end of said line forwardly so that said button contacts said parachute and carries it into the hollow interior of said body.

10. A parachute toy comprising:

a body having a forward portion and a rearward portion joined by a continuous passage opening at opposite terminal ends of the body;

a parachute;

means attaching the parachute to the body rearwardly of the center of gravity of the body for suspending the body forward end down when the parachute is deployed;

a valve member for covering the forward terminal end of the continuous passage for blocking passage of air through the forward terminal end;

an elongated line secured to said valve member and extending rearwardly through said continuous passage for seating the valve member tight against said forward terminal end of the continuous passage during twirling of the body by the line;

means on said line for abutting the rearward surface of said parachute for pulling the parachute into the rearward portion when the line is pulled forwardly in the continuous passage; and forwardly releasing stop means for limiting forward movement of the line so as not to pull against the parachute when the parachute is released in flight, but which can be overcome when a forward force greater than gravity is applied on the line to return the parachute to the body rearward portion.

11. The parachute toy of claim 10, said body rearward portion diverging rearwardly for facilitating the return of the parachute into the body.

* * * * *